United States Patent [19]

Anders

[11] 4,037,424

[45] July 26, 1977

[54] OFFSHORE DRILLING STRUCTURE

[76] Inventor: Edward O. Anders, Houston, Tex.

[21] Appl. No.: 698,839

[22] Filed: June 23, 1976

Related U.S. Application Data

[63] Continuation-in-part of Ser. No. 619,400, Oct. 3, 1975.

[51] Int. Cl.[2] ..... B63B 35/44; B63B 21/27

[52] U.S. Cl. ..... 61/98; 61/99; 61/103; 114/294

[58] Field of Search ..... 61/98, 99, 87, 103, 61/101; 114/206 R, 230, .5 D, 121, 122; 175/91

[56] References Cited

U.S. PATENT DOCUMENTS

| | | | |
|---|---|---|---|
| 3,241,324 | 3/1966 | Storm et al. | 61/88 |
| 3,892,287 | 7/1975 | Bennett | 114/206 R |
| 3,911,687 | 10/1975 | Mo | 61/94 |
| 3,925,997 | 12/1975 | Hafskjold | 61/98 |
| 3,928,982 | 12/1975 | Lacroix | 61/99 |

*Primary Examiner*—Jacob Shapiro

[57] ABSTRACT

An offshore drilling structure of the semi-submersible type wherein holes connect a recessed area in the bottom of the floatable hull with the top of the hull, and reversibly acting thrusters are mounted within the holes.

26 Claims, 7 Drawing Figures

16
1A
1A
31
17
14
10
1B
1
15
1B
15
C
R
26
26
30
23A
23B
12
20
11
S
25
18
29
32
21
24
OV
13
22
13
19

OFFSHORE DRILLING STRUCTURE

This application is a Continuation-in-Part of my copending application, Ser. No. 619,400, filed Oct. 3, 1975, and entitled "Offshore Drilling Structure."

This invention relates generally to offshore drilling structures; and, more particularly, to improvements in floatable type offshore drilling structures in which a working platform is supported above a hull having ballast compartments which permit it to be raised and lowered within the water when at a drilling site.

In one of its aspects, this invention relates to a structure of this type in which the hull may be lowered onto the subsurface to permit it to be used in a submersible mode. In another of its aspects, this invention relates to a structure of this type wherein the platform is supported above the hull by means of hollow legs which also have ballast compartments so that the structure may be used in a semi-submersible mode.

The offshore regions of Northern Alaska, particularly in the Prudhoe Bay area, are believed to possess very extensive deposits of oil and gas. However, due to the shallow water in these regions, which may be no deeper than 45 feet for miles off the coastline, and no more than 5 or 6 feet for substantial distances from the coastline, it has been difficult to move drilling equipment into position over potential drilling sites. Furthermore, these regions are covered with ice during all but the summer season, so that the drilling equipment must be capable of withstanding large shear loads due to the ice sheet as it moves toward the shoreline at the end of the summer.

Because of these problems, it has heretofore been proposed to conduct drilling operations in these regions from either man-made islands or barges which have ballast compartments to permit them to be lowered onto and raised from the subsurface. As will be appreciated, the construction of a man-made island is an expensive and time-consuming operation. Also, of course, when drilling has been completed, there is no way to salvage the island for use at another location. On the other hand, in order to make the drilling barges capable of withstanding the shear load of the ice, it has been proposed to increase their size and weight by considerable amounts. This would not only increase their cost of manufacture, but also make them less maneuverable and thus more difficult to move into and out of drilling sites at shallow water depths. Still further, such drilling barges, although floatable, and thus adapted to be raised from the subsurface for use at other drilling sites, would be usable only in waters in which they may be sunk, and thus not in a semi-submersible mode.

For use in deeper waters of other regions, the offshore drilling structure may be of the above-mentioned semi-submersible type, wherein the hull is submerged to a level beneath the water surface, so that rolling and pitching is minimized by virtue of the small water plane surface presented by the hollow legs. However, there is a need for stabilizing this type of structure, as well as the submersible type, as the ballast tanks are being emptied or filled, and thus as the vessel goes through neutral buoyancy during raising or lowering within the water.

Wave action causes additional problems in the use of the semi-submersible type structures in a drilling mode. Thus, the natural frequency of the structure must be prevented from matching the frequency of the waves, since this would cause severe amplification of motion. The present practices are to minimize this possibility by making the structure considerably heavier, which, as previously mentioned, greatly increases its cost of manufacture.

An object of this invention is to provide a floatable offshore drilling structure of such construction that it is capable of being submerged and withstanding such ice loads without an appreciable increase in size and weight.

Another object is to provide such a structure which is also especially well suited for moving onto and off of drilling sites in very shallow waters.

Still another object is to provide such a structure which is capable of being used not only in a submerged mode in relatively shallow water, but also in a semi-submerged mode where the water is much deeper.

A further object is to provide such a structure which is able to operate in an improved manner in a semi-submersible mode in that it may be stabilized as it is raised or lowered through a state of neutral buoyancy.

These and other objects are accomplished, in accordance with the illustrated embodiment of the invention, by a floatable drilling structure which is of conventional construction in that its hull has ballast compartments which permit it to be lowered onto and raised from the subsurface in the relatively shallow water of an offshore drilling site, but which is an improvement upon conventional structures of this type in that the bottom surface of the hull has a recessed area about the drilling opening in the hull, the hull has holes in it which connect the recessed area with the top of the hull, and a thruster is mounted within each hole for reducing the pressure within the reduced area. Thus, when the hull is lowered onto the subsurface, the thrusters may be operated to draw soil from the subsurface into the recessed area, and thereby form a mechanical lock between the hull and subsurface which prevents the hull from being pushed off of the drilling site by the force of an ice sheet acting laterally against the structure. As illustrated, the recessed area comprises a plurality of recesses arranged symmetrically about the opening in the hull, with the lower end of at least one hole connecting with each recess.

It may be found that, in some cases, the bottom surface of the hull engages so tightly against the subsurface as to substantially seal about the recessed areas. As a result, the liquid flow to the thrusters may be so low as to cause them to cavitate, thereby preventing the maintenance of a negative pressure which is helpful in holding the hull stationary. Therefore, there are additional holes in the hull each of which connects a recess with the top of the hull, and an orifice is arranged in each additional hole so that water may be drawn from above the hull for circulation through the thrusters along with liquid drawn into the recesses from beneath the surrounding bottom surface of the hole. More particularly, each orifice is variable so as to permit flow therethrough, and thus the pressure drop thereacross, to be adjusted to that required to maintain the desired circulation through the thruster.

In the preferred embodiment of the invention, means are also provided for supplying compressed air to the recesses in order to force water therefrom and thereby form an air pocket in the recesses which reduces the draft of the lower hull. This is particularly useful when the structure is being moved onto or away from a drilling site in very shallow water, which may not be more than 5 or 6 feet deep.

More particularly, each of the thrusters is selectively reversible so that the thrust produced thereby may be directed upwardly or downwardly. When directed upwardly, the thrust causes a reduction in pressure beneath it, which is useful for the purpose above described. When directed downwardly, it causes an increase in pressure beneath it so as to assist in raising the hull from its submerged position.

The ability to produce thrusts in either direction is also useful in stabilizing vertical movement of the structure into or out of drilling position, either in a submersible or semi-submersible mode, in that it assists the operator in maintaining it generally horizontal. Furthermore, since the thrusts vary the effective weight of the hull, they are useful to the operator in avoiding severe frequency amplification problems when the structure is used in a semi-submersible state.

Cooling and heating coils are provided in the hull adjacent the recesses so that the liquid within the soil drawn into the recessed area may be frozen to form a more rigid lock; and, alternatively, when it is desired to raise the structure from the drilling site, the frozen liquid may be thawed by the heating coils. Also, the heating coils may be used when the hull is first lowered onto the subsurface to that the soil so as to render it more flowable and thus easier to draw into the recessed area.

The outer sides of the hull include upper downwardly and outwardly extending portions and lower downwardly and inwardly extending portions which intersect beneath the normal draft level. Thus, when the hull is lowered onto a subsurface beneath water no deeper than the height of the hull, the upper downwardly extending portions of the sides of the hull will tend to divert the sheet of ice upwardly. Preferably, the hollow legs which support the working platform a substantial distance above the hull extend upwardly and inwardly from the upper portions of the sides of the hull to the working platform so that they will divert an ice sheet when the hull is lowered to a depth in which the water is at a level intermediate the hull and platform.

In the drawings, wherein like reference characters are used throughout to designate like parts:

Figure 1:
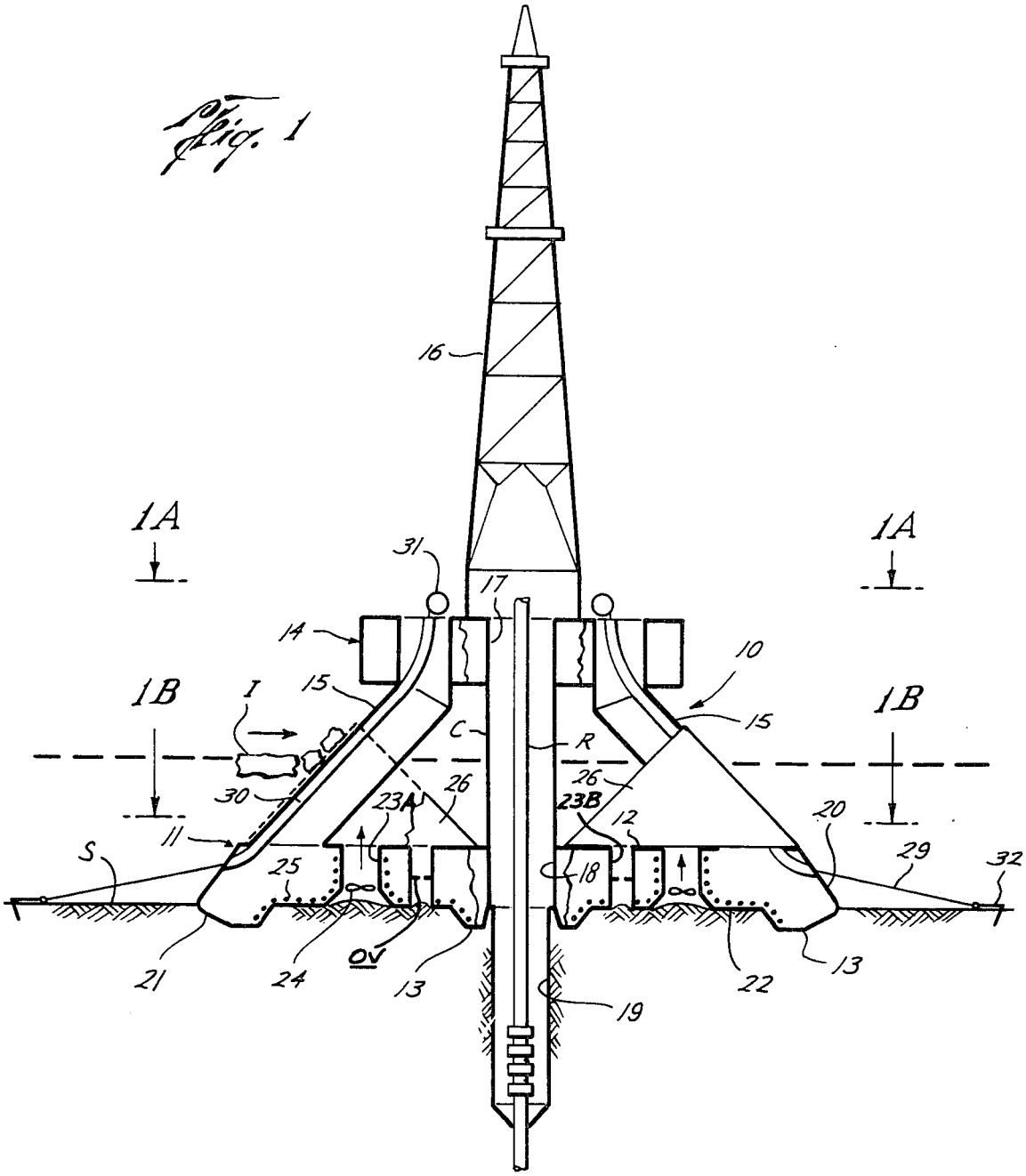
FIG. 1 is a vertical elevational view of an offshore drilling structure constructed in accordance with the present invention, and disposed in a submerged drilling mode with its hull resting upon the subsurface.

With reference now to the details of the above-described drawings, the drilling structure shown in each of the Figures, and designated in its entirety by reference character 10, includes a hull 11 which is of generally rectangular configuration in plan and which has generally parallel top and bottom walls 12 and 13, respectively. As in the case of conventional offshore drilling structures of this general type, hull 11 is provided with ballast compartments (not shown) which permit ballast to be taken on or disposed of in a well known manner which does not require specific illustration or description.

Structure 10 is also similar to a conventional submersible type of structure in that it includes a working platform 14 which is supported above hull 11 by means of hollow legs 15. As in the case, also, of conventional semi-submersible structures of this type, the legs 15 are also provided with compartments (not shown) for taking on or disposing of ballast in a well known manner.

Figure 2:
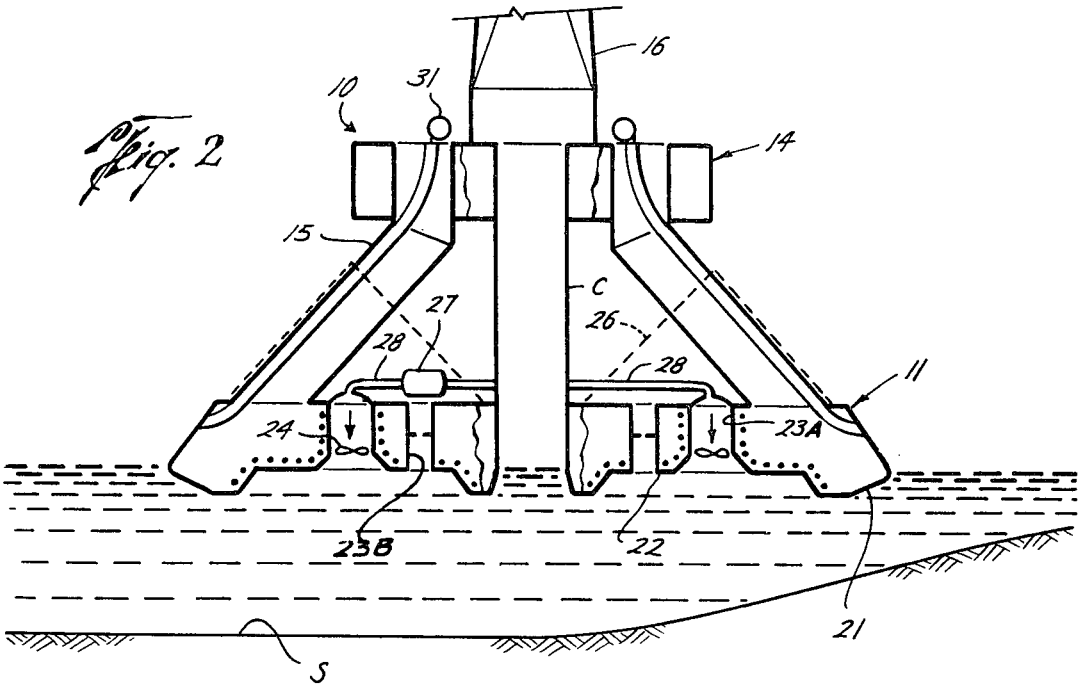
FIG. 2 is a partial vertical sectional view, similar to FIG. 1, but with the structure in transport position preparatory to or during movement from the drilling site of FIG. 1 to a shallower depth of water at another drilling site.
Figure 3:
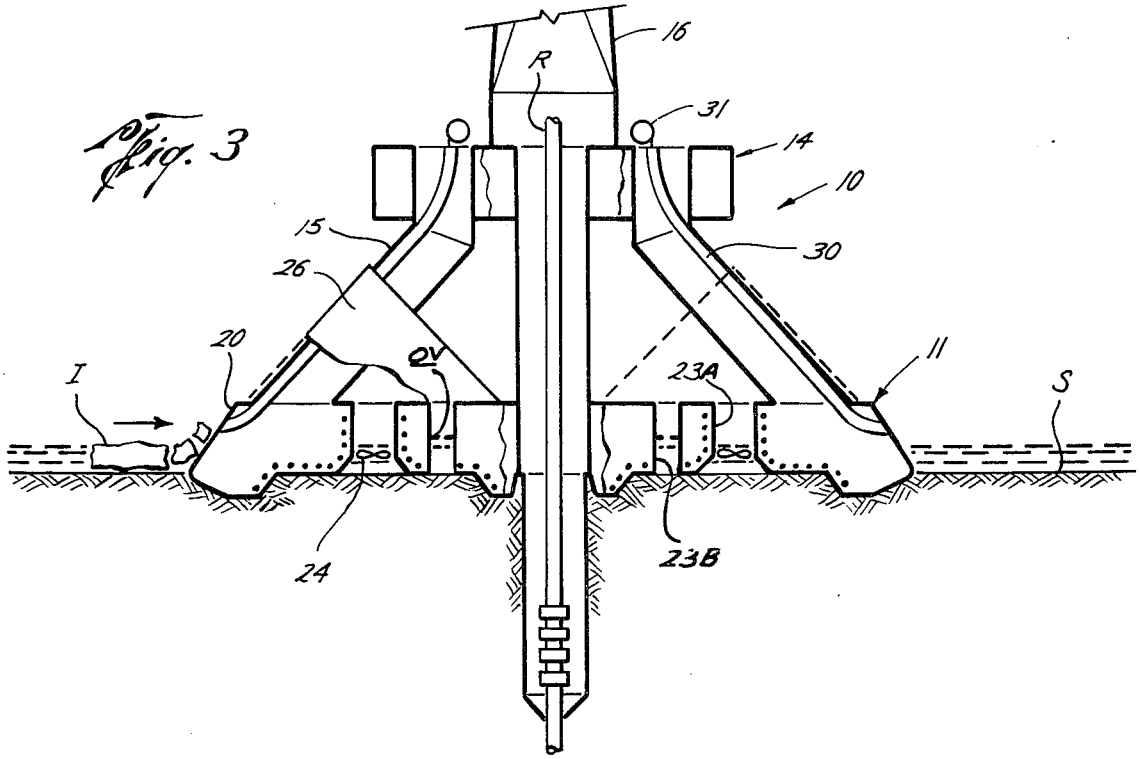
FIG. 3 is a view similar to FIG. 2, but with the hull lowered onto the subsurface for drilling in a submersible mode at the drilling site beneath the shallower depth of the water.
Figure 4:
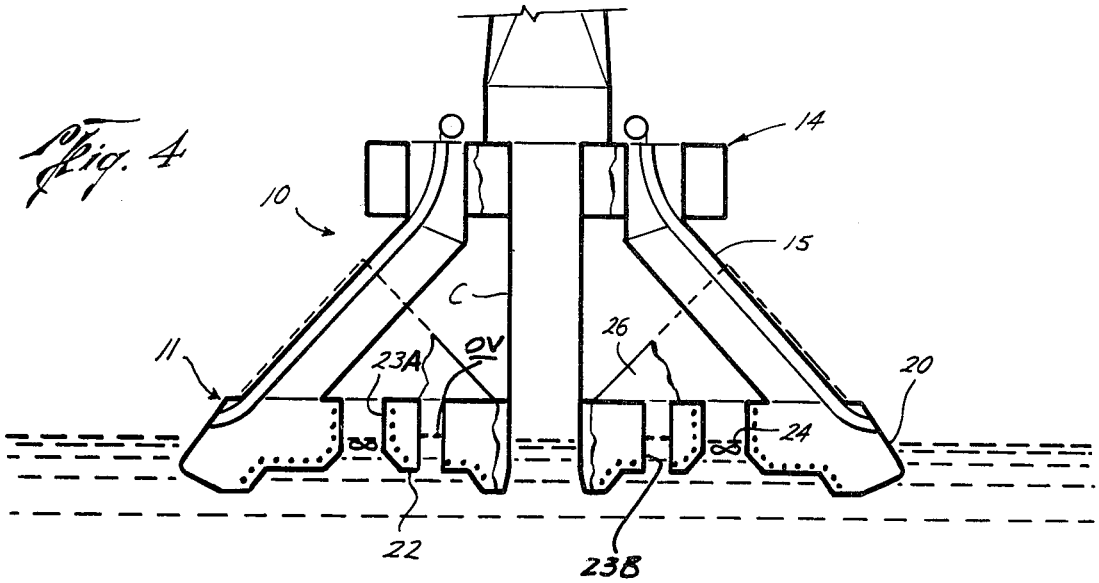
FIG. 4 is another partial vertical sectional view of the structure, during transport in deeper offshore waters.
Figure 5:
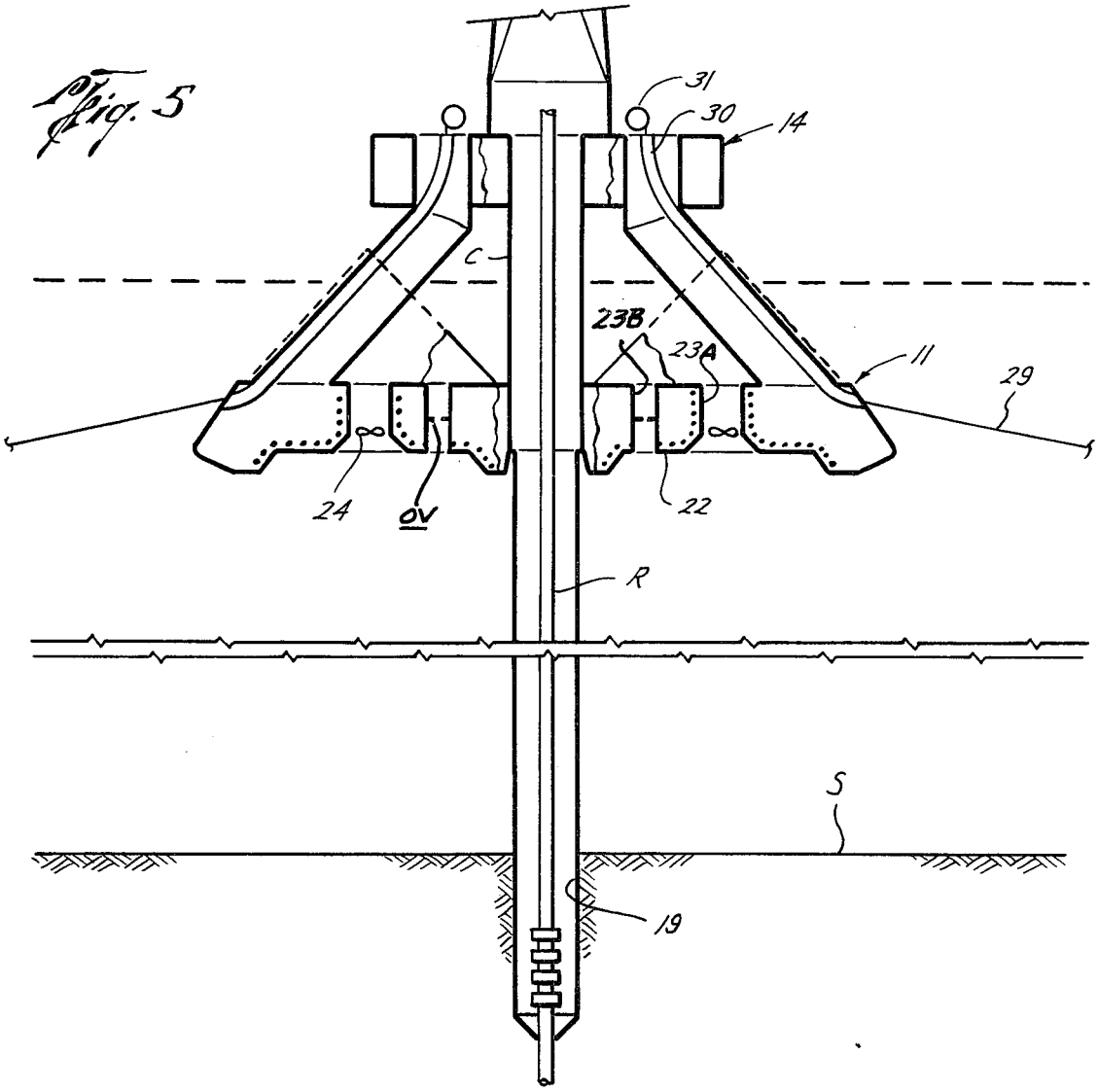
FIG. 5 is a view similar to FIG. 4, with the structure lowered to a semi-submersible drilling mode.

Thus, in the use of structure 10, the ballast compartments of the hull and legs permit the structure to be raised and lowered between transport and drilling positions. In FIGS. 1 and 3, the hull has been lowered onto the subsurface so as to dispose the structure in a submersible state, in which case the water may be at a minimum level intermediate the top and bottom of the hull, as shown in FIG. 3, or at a level a substantial distance upwardly along the height of legs 15, as shown in FIG. 1. When the structure is lowered for drilling in a semi-submersible state, as shown in FIG. 5, the hull is beneath the water surface, which is at a level intermediate the upper and lower ends of the legs. When the structure is in transport position, as shown in FIGS. 2 and 4, the water surface is at a level intermediate the top and bottom of the hull.

A derrick 16 and other conventional drilling equipment are supported on the platform 15 for use in drilling a well bore within the subsurfaces. As shown, the derrick 16 is above vertically aligned openings 17 and 18 through the platform 14 and hull 11, respectively, whereby drilling equipment such as a riser pipe R may be lowered therethrough into a conductor casing C extending downwardly through the platform and hull into a wellbore 19 within the subsurface S.

For purposes previously described, the outer sides of hull 11 include upper portions 20 which extend downwardly and outwardly from the top 12 thereof, and lower portions 21 which extend upwardly and outwardly from bottom 13. In addition, and as also previously described, the legs 15 extend upwardly and inwardly from the upper portions 20 of the sides of the hull. The platform 14 is of less extent in plan than is the hull 11, but arranged symmetrically with respect thereto. With the hull and platform of rectangular configuration, there would normally be four legs each extending from adjacent one corner of the hull to adjacent one corner of the platform.

Figure 1B:
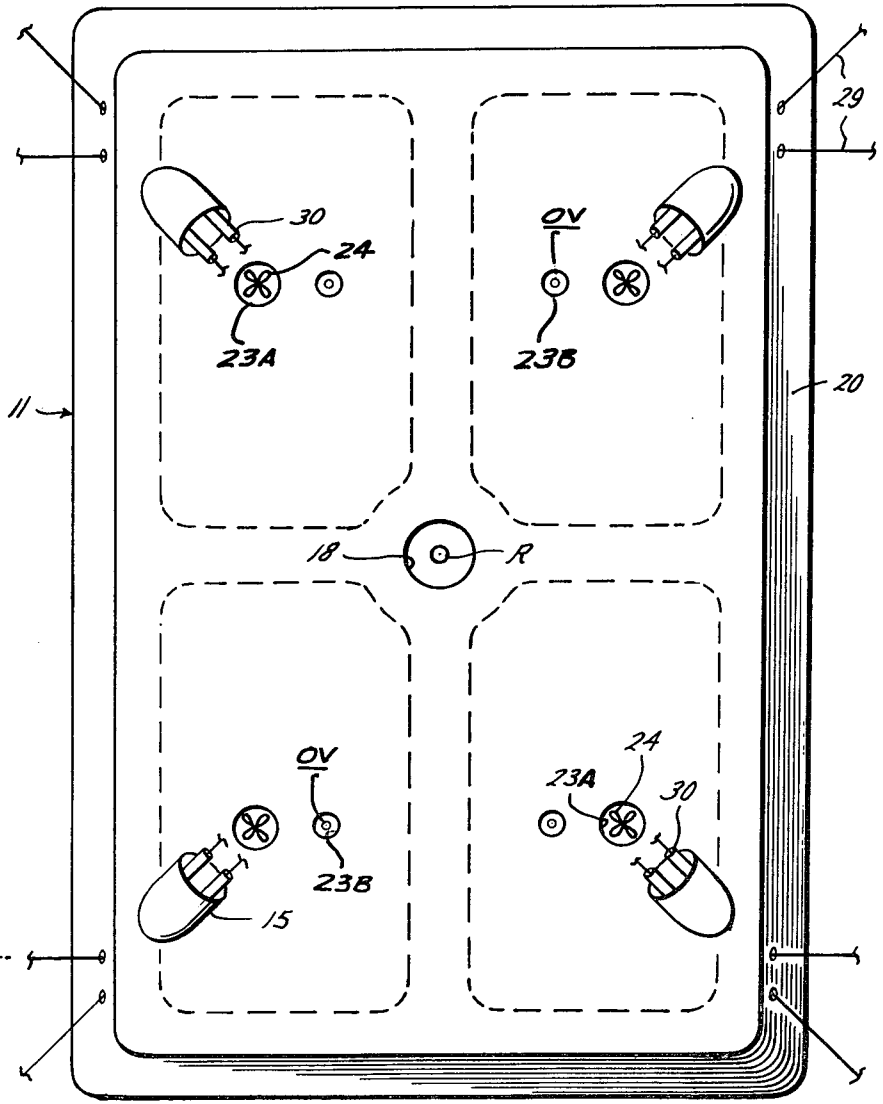
FIGS. 1A and 1B are horizontal sectional views of the structure of FIG. 1, as seen along broken lines 1—A and 1—B thereof, respectively.
Figure 1A:
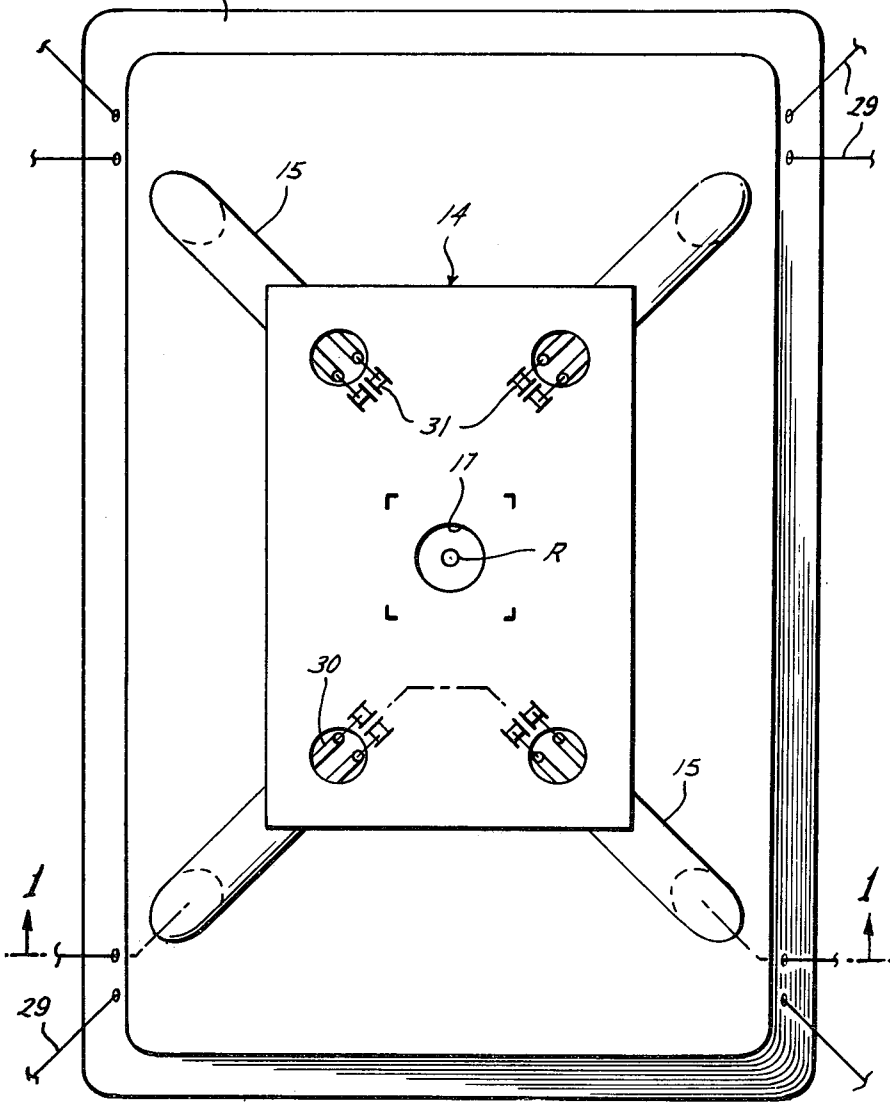

The bottom 13 of the hull is provided with a recessed area including a plurality of recesses 22 arranged symmetrically about opening 18 in the hull. As shown in FIG. 1B, there are four such recesses, each being of the same size and disposed in one quadrant of the rectangular plan of the hull 11. A series of holes are formed in the hull 11 to connect its top 12 with its bottom 13, with the lower end of each hole opening to a recess 22. More particularly, there are two sets of holes 23A and 23B, with one hole of each set opening to a recess. As shown in FIG. 1B, the holes are preferably arranged equal distances from hull opening 18, and thus symmetrically thereof.

A thruster 24 is mounted within each hole 23A, and although the thrusters are merely shown diagrammatically, it will be understood that each comprises an axial flow propeller having blades mounted for rotation about the vertical axis of hole 23A. In accordance with the present invention, the direction of thrust produced by each thruster may be reversed, either by reversing the direction of rotation of the thruster, or by reversing pitch of its blades. Also, of course, the magnitude of the thrust may be controlled by adjustment of the speed of rotation of the blades, pitch of the blades, or both.

With the hull lowered onto the subsurface to dispose the structure in a submersible mode, and with the hull beneath water level, as shown in FIG. 1, operation of the thrusters to produce an upward thrust is effective to reduce the pressure beneath it, and thus circulate liquid upwardly through holes 23A in order to draw soil into the recess so as to substantially fill same. If additional fill is desired, it may be added through the upper end of the holes 23A. The thrusters are continued in operation until they begin to cavitate or zero pressure differential is measured across them, at which time the operator knows that thrusters have drawn as much of the soil as possible into the recesses.

This mass of soil in the recesses, as shown in FIG. 1, effectively locks the hull to the subsurface, so as to resist the shear force of the ice sheet I as it moves in the direction of the arrow shown in FIG. 1 toward the shoreline. Heating and cooling coils 25 are mounted within the hull adjacent the recesses so that if a stronger lock is desired, refrigerant may be passed through the coils so as to freeze the water in the soil drawn up into the recesses.

However, and as previously mentioned, the bottom surface of the hull surrounding each recess may engage the subsurface so tightly as to effectively form a seal therewith. As a result, there may be insufficient liquid flow into the recesses to feed thrusters 24, thereby causing the thrusters to quickly cavitate and the negative pressure in the recess to be lost. In order to maintain such pressure, an orifice is arranged in each hole 23B to permit water to be drawn from the top of the hull into the recess in order to maintain an adequate supply to the thruster. More particularly, each orifice is variable in size, as illustrated diagrammatically at OV, so as to adjust the water flow therethrough, and thus the pressure drop thereacross, to the capacity of the thruster. This then provides a means for forcing the hull against the subsurface by maintaining a negative pressure in one or more of the recesses. Each variable orifice OV may, of course, be of any suitable construction which permits the orifice to be varied from full open to closed.

In the FIG. 3 mode of the vessel, the water level is beneath the upper ends of holes 23A so that the thrusters are not effective to cause circulation therethrough and thus to fill recesses 22 with soil. However, soil may be introduced through the upper ends of holes 23A, particularly if the vessel is to be used for production purposes. The subsurface may be permafrost, which is frozen silt and ice, and a heating medium may be circulated through coils 25 to thaw the permafrost sufficient to permit the lower edges of the vessel to sink into it, as shown in FIG. 3. Thus, upon refreezing, the permafrost forms a lock with each recess.

When it is desired to raise the structure from the submerged drilling mode shown in FIGS. 1 and 3, heated fluid may instead be circulated through the coils 25 so as to thaw the ice formed in the recesses 22, thereby facilitating release of the hull from the subsurface. Still further, the coils may be used in heating the subsurface as the bottom of the hull is lowered onto it, as might be desired in the event the subsurface is frozen solid, and softening the soil is desired in order to facilitate its being drawn into the recesses.

As can be seen from FIGS. 1 and 3, the upwardly and inwardly extending portions of the sides of the hull and legs 15 are useful in diverting the ice sheet I as it flows inwardly toward the shoreline. That is, these upwardly slanting surfaces will create an upward component of force on the edge of the sheet, causing it to break up and thus pass over the upwardly and inwardly extending walls with a minimum of lateral force thereagainst. In the same respect, a conical shield 26 having downwardly and outwardly tapering sides is preferably disposed about each leg 15 so as to provide additional ice sheet deflecting surfaces. Thus, as will be understood from FIG. 1, in the event parts of the ice sheet flowing from left to right move between the left legs 15, it would then be intercepted by the upwardly tapering lefthand side of the righthand shroud 26

If it is necessary to reduce the draft of the hull as it is moved into or out of the drilling site of FIG. 3, wherein the water is less than the natural draft of the hull, compressed air or other gas is forced into the recesses 22 to form air pockets by displacing water therein outwardly beneath the lower edges of the hull bottom 13. Preferably, and as shown in FIG. 2, this is accomplished with air from a source 27 of compressed air mounted on the hull 11 and having conduits 28 removably connected with the top ends of the holes 23. Thus, when the thrusters 22 are not operating within the holes, air from the source 27 may be forced outwardly therethrough into each of the recesses. As can be seen from FIG. 2, this displacement of water in the recesses lowers the draft of the hull 11, and thus causes it to assume a position in the water in which the water level is substantially adjacent the intersection of the upper and lower portions of the side walls of the hull.

When the structure is in a submersible drilling mode in water of the depth indicated in FIG. 1, it may be desired to anchor the structure to the subsurface by means of guy lines 29. These guy lines extend from wenches 31 on the platform downwardly through funnels 30 extending within the hollow legs 15 for connection with anchors 32 (see FIG. 1) for embedding within the subsurface, as shown.

The structure may be lowered to the semi-submersible drilling mode of FIG. 5 by manipulation of the ballast tanks in the hull and legs 15. When the structure is in this drilling mode, it assumes a level in which the water surface is intermediate the upper and lower end of the legs, whereby the structure presents a minimum of plane surface at the water level. In this mode, the hull may be several hundred feet or more below the subsurface, so that the conductor pipe C extending downwardly through the hull opening 18 and into the upper end of the wellbore 19 may also be of considerable length. The guy lines 29 are also useful in this mode in tending to maintain the structure in generally upright position.

During transport, in either deep or shallow water, the thrusters may be used to adjust the effective weight of the structure. The structure may also be stabilized as the hull is raised and lowered in the water, and especially when in a state of neutral buoyancy, by operating the thrusters in a selective manner. Thus, for example, should one corner or side be higher than an opposite corner or side, the thrusters may be operated to move the hull and thus the structure to a more level position.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. An offshore drilling structure, comprising a hull adapted to float on the water surface, during transit, and having ballast compartments which permit it to be raised and lowered within the water, when at a drilling site, a working platform supported above the hull, said platform and hull having openings therethrough to pass drilling equipment between the platform and the subsurface, the bottom of the hull having a recessed area about the opening in the hull, said hull having holes connecting said recessed area with its top, and a thruster mounted within each hole for reducing the pressure within the recessed area so that, when the hull is supported on the subsurface, soil from the subsurface may be drawn into the recessed area.

2. An offshore drilling structure of the character defined in claim 1, including heating and cooling means in the hull adjacent said recessed area.

3. An offshore drilling structure of the character defined in claim 1, including means for supplying compressed air to said recessed area in order to force water therefrom and thereby reduce the draft of the hull.

4. An offshore drilling structure of the character defined in claim 3, wherein said air supplying means includes a source of compressed air, and means connecting the source with the holes in the hull.

5. An offshore drilling structure of the character defined in claim 1, wherein the outer sides of the hull include upper downwardly and outwardly extending portions, and lower downwardly and inwardly extending portions which intersect beneath the normal draft level.

6. An offshore drilling structure, comprising a hull adapted to float on the water surface, during transit, a working platform upon which drilling equipment may be supported, legs supporting the platform above the hull, said hull and legs having ballast compartments which permit the hull to be raised and lowered within the water, when at a drilling site, said platform and hull having openings therethrough to pass drilling equipment between the platform and the subsurface, the bottom of the hull having a recessed area about the opening in the hull, said hull having holes connecting said recessed area with its top, and a thruster mounted within each hole for reducing the pressure within the recessed area so that, when the hull is supported on the subsurface, soil from the subsurface may be drawn into the recessed area.

7. An offshore drilling structure of the character defined in claim 6, including heating and cooling means in the hull adjacent said recessed area.

8. An offshore drilling structure of the character defined in claim 6, including means for supplying compressed air to said recessed area in order to force water therefrom and thereby reduce the draft of the hull.

9. An offshore drilling structure of the character defined in claim 8, wherein said air supplying means includes a source of compressed air, and means connecting the source with the holes in the hull.

10. An offshore drilling structure of the character defined in claim 6, wherein the outer sides of the hull include upper downwardly and outwardly extending portions, and lower downwardly and inwardly extending portions which intersect beneath the normal draft level.

11. An offshore drilling structure of the character defined in claim 10, wherein each of the legs extends upwardly and inwardly from the upper portions of the outer sides of the hull.

12. An offshore drilling structure of the character defined in claim 6, wherein the outer sides of the hull have upwardly and inwardly extending portions, and each of the legs extends upwardly and inwardly from the hull as substantial continuations of said portions of the platform.

13. An offshore drilling structure of the character defined in claim 12, including a downwardly and outwardly tapered shroud about each leg.

14. An offshore drilling structure, comprising a hull adapted to float on the water surface, during transit, a working platform upon which drilling equipment may be supported, legs supporting the hull above the hull, said hull and legs having ballast compartments which permit the hull to be raised and lowered within the water, when at a drilling site, said platform and hull having openings therethrough to pass drilling equipment between the hull and the subsurface, said hull having holes therein connecting the top and bottom therein and arranged substantially symmetrically about the opening in the hull, a thruster mounted with each hole with its axis of rotation arranged substantially coaxially thereof, and means for selectively reversing the axial direction in which thrust from each of the thrusters is effective.

15. An offshore drilling structure of the character defined in claim 14, wherein the bottom of the hull has a recessed area about the opening in the hull, and the lower end of each of said holes connects with the recessed area.

16. An offshore drilling structure of the character defined in claim 15, wherein the recessed area comprises a plurality of recesses arranged about opening in the hull, and the lower end of at least one hole connects with each recess.

17. An offshore drilling structure of the character defined in claim 16, including heating and cooling means in the hull adjacent each recess.

18. An offshore drilling structure of the character defined in claim 16, including means for supplying compressed air to each recess in order to force water therefrom and thereby reduce the draft of the hull.

19. An offshore drilling structure of the character defined in claim 18, wherein said air supplying means includes a source of compressed air, and means connecting the source with the holes in the hull.

20. An offshore drilling structure, comprising a hull adapted to float on the water surface, during transit, and having ballast compartments which permit it to be raised and lowered within the water, when at a drilling site, a working platform supported above the hull, said platform and hull having openings therethrough to pass drilling equipment between the platform and the subsurface, the bottom of the hull having a recessed area about the opening in the hull, said hull having first and second sets of holes connecting said recessed area with its top, a thruster mounted within each hole of the first set for reducing the pressure within the recessed area so that, when the hull is supported on the subsurface, soil from the subsurface may be drawn into the recessed area, and a variable orifice arranged in each hole of the second set so as to supply said thrusters with a continuing supply of water.

21. An offshore drilling structure of the character defined in claim 20, including heating and cooling means in the hull adjacent said recessed area.

22. An offshore drilling structure of the character defined in claim 20, including means for supplying compressed air to said recessed area in order to force water therefrom and thereby reduce the draft of the hull.

23. An offshore drilling structure of the character defined in claim 22, wherein said air supplying means includes a source of compressed air, and means connecting the source with the first set of holes in the hull.

24. An offshore drilling structure of the character defined in claim 20, wherein the outer sides of the hull include upper downwardly and outwardly extending portions, and lower downwardly and inwardly extending portions which intersect beneath the normal draft level.

25. An offshore drilling structure of the character defined in claim 20, including means for selectively reversing the axial direction in which thrust from each of the thrusters is effective.

26. An offshore drilling structure of the character defined in claim 22, including means for selectively reversing the axial direction in which thrust from each of the thrusters is effective.

* * * * *